US007272553B1

(12) United States Patent
Chrissan et al.

(10) Patent No.: US 7,272,553 B1
(45) Date of Patent: Sep. 18, 2007

(54) VARYING PULSE AMPLITUDE MULTI-PULSE ANALYSIS SPEECH PROCESSOR AND METHOD

(75) Inventors: Douglas A. Chrissan, Sunnyvale, CA (US); Rajarathinam G. Subramanian, Santa Clara, CA (US)

(73) Assignee: 8x8, Inc., Santa Clara, CA (US)

( * ) Notice: Subject to any disclaimer, the term of this patent is extended or adjusted under 35 U.S.C. 154(b) by 909 days.

(21) Appl. No.: 09/392,124

(22) Filed: Sep. 8, 1999

(51) Int. Cl.
*G10L 19/10* (2006.01)

(52) U.S. Cl. ..... 704/219

(58) Field of Classification Search ..... 704/219, 704/220, 221, 222, 223, 212
See application file for complete search history.

(56) References Cited

U.S. PATENT DOCUMENTS 4,932,061 A 6/1990 Kroon et al.
5,125,030 A * 6/1992 Nomura et al. ..... 704/222
5,444,816 A * 8/1995 Adoul et al. ..... 704/219
5,568,588 A 10/1996 Bialik et al.
5,754,976 A * 5/1998 Adoul et al. ..... 704/223
5,974,377 A * 10/1999 Navarro et al. ..... 704/201
5,991,717 A * 11/1999 Minde et al. ..... 704/203

OTHER PUBLICATIONS

Deller et al.; Discrete-time processing of speech signals; IEEE Signal Processing Society; 1993; pp. 333-338.*
Bernard Sklar; Digital Communications Fundamentals and Applications; Prentice Hall; 1988; pp. 60-65.*

* cited by examiner

*Primary Examiner*—Abul K. Azad
(74) *Attorney, Agent, or Firm*—Crawford Maunu PLLC

(57) ABSTRACT

A speech signal processing approach modifies the amplitudes of pulses within a multi-pulse sequence to improve and/or modify the perceived quality of reconstructed speech. According to one embodiment that is consistent with the present invention, an input frame processing arrangement generates the short-term characteristics of an input speech signal and also a target vector. The processing arrangement includes an analyzer that operates to provide an optimal analysis, from a maximum-likelihood standpoint, with respect to determining the best possible pulse sequence to match the target. The analyzer receives the target vector and the short term characteristics and generates a plurality of sequences of variable-amplitude pulses, each of said sequences having a different average amplitude value. The analyzer is further adapted to output a signal corresponding to a sequence of either equal-amplitude or unequal-amplitude pulses which, according to a maximum likelihood criterion, would closely represent the target vector.

32 Claims, 2 Drawing Sheets

VARYING PULSE AMPLITUDE MULTI-PULSE ANALYSIS SPEECH PROCESSOR AND METHOD

FIELD OF THE INVENTION

The present invention relates generally to speech signal processing and, more particularly, to multi-pulse speech analysis and synthesis systems.

BACKGROUND OF THE INVENTION

Speech signal processing is well known in the art and is often utilized to compress an incoming speech signal for applications such as storage and transmission. The speech signal processing typically involves dividing the incoming speech signals into frames and then analyzing each frame to determine its representative components. The representative components are then stored or transmitted.

A frame analyzer is often used to determine the short-term and long-term characteristics of the speech signal. The frame analyzer can also determine one or both of the short- and long-term components, or contributions, of the speech signal. As an example, linear prediction coefficient (LPC) analysis provides the short-term characteristics and contribution, and pitch analysis and prediction provides the long-term characteristics as well as the long-term contribution.

Typically, one, both or neither of the long- and short-term predictor contributions are subtracted from the input frame, leaving a target vector whose shape has to be characterized. Such a characterization can be produced with multi-pulse analysis (MPA) which is described in detail in section 6.4.2 of the book *Digital Speech Processing, Synthesis and Recognition* by Sadaoki Furni, Marcel Dekker, Inc., New York, N.Y. 1989, incorporated herein by reference.

Conventionally, MPA involves a target vector that is formed of a multiplicity of samples. The target vector is modeled by a plurality of pulses of equal amplitude varying in location and varying in sign (positive and negative). To select each pulse, a pulse is placed at each sample location and the effect of the pulse, defined by passing the pulse through a filter defined by the LPC coefficients, is determined. The pulse which provides the filter output that most closely matches the target vector is selected and its effect is removed from the target vector, thereby generating a new target vector. The process continues until a predetermined number of pulses have been found. For storage or transmission purposes, the result of the MPA analysis is a collection of pulse locations, pulse signs (positive or negative), and a quantized value of the pulse amplitude.

The MPA output typically specifies the resulting pulse locations, but not the order in which they were chosen. It also specifies only one gain parameter, so the decoder must reconstruct the pulse sequence using equal amplitudes for all the pulses. In addition, the MPA analysis itself is sub-optimal, from a maximum-likelihood standpoint, with respect to determining the best possible pulse sequence to match the target.

Accordingly, there is need for a speech processor and method that improves the performance of the MPA process and the perceptual quality of the reconstructed speech and that overcomes the above-mentioned deficiencies of the prior art.

SUMMARY

According to certain embodiments, the present invention provides a speech processing method and arrangement including a process applicable for use in connection with the ITU G.723.1 speech encoding recommendation. Certain embodiments of the invention are applicable to multipulse maximum likelihood quantization coding systems and processes.

Particular embodiments involve method and structure approaches directed to speech processing systems in which a signal processor arrangement analyzes an input speech signal and, in response, generates the short-term characteristics of the input speech signal and a target vector. One such approach involves: generating from the target vector and the short term characteristics, a plurality of sequences of variable-amplitude pulses, each of the sequences having a different average amplitude value; and outputting a signal corresponding to a sequence of equal-amplitude pulses which, according to an error criterion, represents the target vector.

Another particular application of the present invention involves a speech processing method and arrangement that utilizes pulse sequences of varying amplitude pulses in one or both of the MPA unit and the decoder. In particular embodiments, pulse sequences of varying amplitude pulses are used in each of the MPA unit and the decoder; the MPA unit and not the decoder; and the decoder and not the MPA unit. The digitally compressed representative signal need not contain additional information about the variation of the pulse amplitudes or about the order in which the pulses were chosen.

In these particular applications, the pulse amplitude variation within a given sequence is typically small relative to the average amplitude of the sequence. A typical ratio is 20-30 percent.

One important aspect of the present invention is directed to the performance of the MPA process and the perceptual quality of the reconstructed speech. Consistent with this aspect of the present invention, another particular example embodiment involves a speech processing system that includes a short-term analyzer, a target vector generator and a multi-pulse analysis unit. The system optionally includes a long-term analyzer, and the MPA unit can use a maximum-likelihood criterion for evaluating the error of a given pulse sequence. The target vector is generated from the input speech signal or a perceptually modified version of the input speech signal, and the MPA unit operates on at least the target vector and the short-term characteristics determined by the short-term analyzer.

In another particular example embodiment of the present invention, the MPA varies the amplitudes of the pulses in each pulse sequence when choosing the pulse locations within a given pulse sequence, and utilizes equal amplitude pulses when determining the best pulse sequence based on the given error criterion. In another embodiment of the present invention, the encoder varies the amplitudes of the pulses in each pulse sequence when determining the best pulse sequence based on the given error criterion, but the decoder does not have knowledge of these pulse amplitude variations. In a third embodiment of the present invention, both the encoder and the decoder have knowledge of the variation of the pulse amplitudes in a given pulse sequence. The encoder takes these amplitude variations into account when choosing the pulse locations within a given pulse sequence and/or when choosing the best pulse sequence based on the given error criterion. The encoder and decoder may utilize one or both of: a predetermined pulse modification function, and a pulse modification function derived from parameters or signals known by both the encoder and decoder. Example signals known by both the encoder and decoder are: the LPC parameters (short-term characteristics), the long-term pitch parameters (long-term characteristics), and the previous excitation signal.

Another embodiment of the present invention uses pulse-train sequences instead of pulse sequences. Each pulse train in a pulse-train sequence consists of equal amplitude, equal sign, equally spaced pulses, and the different pulse trains have varying amplitudes.

Another embodiment of the present invention uses pulse-train sequences with each pulse train in a pulse-train sequence consisting of variable amplitude, variable sign, and equally spaced pulses. Further, the different pulse trains have varying average amplitudes.

In other embodiments, the above embodiments are combined in one of various ways for a given system and application. In one system, for instance, both a varying-amplitude multi-pulse pulse sequence analysis and a varying-amplitude multi-pulse pulse train analysis are performed and the one resulting in the closest match to the target vector is chosen as the MPA unit's output signal.

The above summary of the invention is not intended to describe each disclosed embodiment of the present invention. An overview of other example aspects and implementations will be recognizable from the figures and of the detailed description that follows.

BRIEF DESCRIPTION OF THE DRAWINGS

The present invention will be understood and appreciated more fully from the following detailed description taken in conjunction with the drawings in which.

Figure 1:
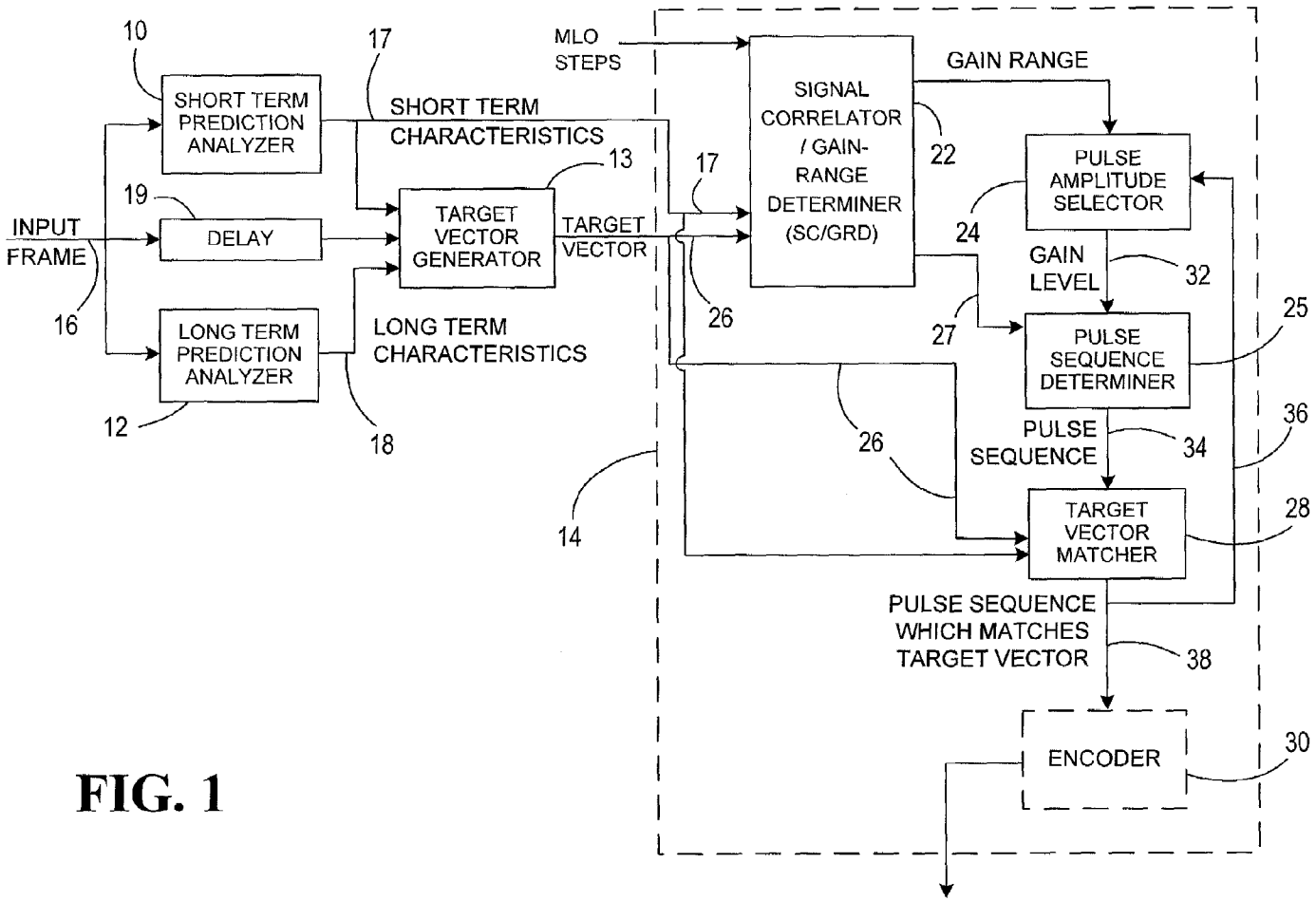
FIG. 1 is a block diagram illustrating a speech processing system, according an example embodiment of the present invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

DETAILED DESCRIPTION

The present invention is generally applicable to speech processing arrangements involving multi-pulse signal representation where accurate signal representation is important to system operation. The present invention has been found to be particularly advantageous for systems of this type when implemented in compliance with conventional speech encoding systems, such as those intending to be compliant or compatible with the ITU G.723.1 and other speech encoding recommendations involving multipulse coding arrangements and methods.

A particular example application is a video and speech encoding/decoding system such as used for videoconferencing. Such a system is described in connection with U.S. patent application Ser. No. 09/005,053, filed on Jan. 9, 1998 and issued as U.S. Pat. No. 6,124,882 on Sep. 26, 2000, which is incorporated herein by reference. The example video-control units and video-processing circuits illustrated and described therein employ a multiple-processor structure including a digital signal processor ("DSP") and a RISC processor. The DSP is arranged to handle specialized tasks such as compression and decompression of video and speech information, and the RISC processor is arranged to process most other functions. Alternatively, this example speech-processing embodiment is implemented using a dedicated DSP.

An appreciation of the various advantages and aspects of the invention can be realized using such an example video-conferencing application. For the purpose of conveying these various advantages and aspects, FIG. 1 and its related discussion illustrate various example embodiments of the present invention in the context of a speech-processing arrangement and as may be used in a videoconferencing system such as described above.

Reference is now made to FIG. 1, which generally illustrates an example embodiment of the present invention as applied to a speech-processing application. The depicted speech processing system includes various functional blocks, including a short-term prediction analyzer 10, a long-term prediction analyzer 12, a target vector generator 13 and a multi-pulse analysis (MPA) unit 14. The functions of the short-term prediction analyzer 10, the long-term prediction analyzer 12, and the target vector generator 13 can be implemented in any of a number of ways to process input frames of a speech signal formed of a multiplicity of digitized speech samples.

In one example, input speech is in the form of 240 speech samples per frame, each frame is separated into a plurality of four subframes, and each subframe is sixty samples long. The input frame can be a frame of an original speech signal or of a processed version thereof. The short-term prediction analyzer 10 receives the input frame and produces on signal line 17, the short-term characteristics of the input frame. In one specific embodiment, short-term prediction analyzer 10 performs linear prediction analysis to produce linear prediction coefficients (LPCs) that characterize each input frame, and with each subframe being processed one at a time.

The long-term predictor analyzer 12 also operates on the input frame received on line 16. The long-term analyzer 12 analyzes a plurality of subframes of the input frame to determine the pitch value of the speech within each subframe, where the pitch value can be defined as the number of samples after which the speech signal approximately repeats itself. In many applications, pitch values typically range between 20 and 146, where 20 indicates a high-pitched voice and 146 indicates a low-pitched voice.

Once the long-term analyzer 12 determines the pitch value, the pitch value is utilized to determine the long-term prediction information for the subframe, provided on the signal line 18.

The target vector generator 13 outputs a target vector for processing by the MPA unit 14 in response to the output signals of the long-term analyzer 12 and of the short-term prediction analyzer 10 and in response to the input frame, via a delay 19. Using these signals, target vector generator 13 generates the target vector from one or more subframes of the input frame. Various aspects of the long-term and short-term information can be utilized, if desired, or they can be ignored. The delay 19 is used to delay the input frame so that it arrives at the target vector generator 13 so as to correspond to the respective outputs of the analyzers 10 and 12.

As indicated in FIG. 1, the MPA unit 14 receives as inputs a short-term impulse response (IR) and a target vector along signal lines 17 and 26, respectively. Using the example system front-end feeding the MPA unit 14, the short-term impulse response is, or produced as part of, the short-term characteristics produced by the short-term prediction analyzer 10, and the target vector is received from the target vector generator 13. In another front-end embodiment, the short-term impulse response (IR) is received from a short-term analyzer and a target vector is received from another type of target vector generator.

The MPA unit 14 of FIG. 1 includes various functional blocks. These blocks are a signal correlator and gain-range determiner (SC/GRD) 22, a pulse amplitude selector 24, a pulse sequence determiner 25, a target vector matcher 28, and an optional encoding unit 30. These blocks process the short-term impulse response and the target vector, according to the present invention, to identify and encode one of a number of the pulse sequence candidates that best matches to the target vector. Such an encoded pulse sequence and its parameters are shown as being output of the MPA unit 14.

Using the received short-term impulse response and the target vector, the SC/GRD 22 calculates the autocorrelation of the impulse response and the cross-correlation between the impulse response and the target vector. This calculation can be accomplished, for example, as in the above-referenced ITU G.723.1 speech processing recommendation.

These two correlation signals are used by the SC/GRD 22 to determine an initial pulse gain and pulse location. In one specific implementation, the initial pulse gain and pulse location are determined as presented in the above-referenced ITU G.723.1 speech processing recommendation. The amplitude of a given pulse sequence to be searched is typically referred to as the quantized gain of the pulse sequence, and in many embodiments a range of gains is searched. In the example embodiment of FIG. 1, the range of gains searched, the pulse gain and pulse location of the current pulse sequence are output to the pulse amplitude selector 24. The two correlation signals calculated by the SC/GRD 22 are also output to the pulse sequence determiner 25, as depicted at signal line 27.

The pulse amplitude selector 24 receives the gain range and moves through the gain values within the gain range that was obtained from the SC/GRD 22. The pulse amplitude selector 24 then outputs the pulse amplitude of the current pulse sequence, depicted at signal line 32. This current pulse sequence, as provided at signal line 32, is a current gain level for which a sequence of pulses is to be determined.

The pulse sequence determiner 25 receives the two correlation signals from the SC/GRD 22 (signal line 27) and the pulse amplitude of the current pulse sequence from the pulse amplitude selector 24, and performs a multi-pulse analysis to determine the signs and locations of the pulses in the pulse sequence. The current pulse sequence on output line 34 is analyzed by the target vector matcher 28, which compares the fit of the current pulse sequence to the target vector with the fit of previously analyzed pulse sequences based on the given error criterion. For each gain value, the target vector matcher 28 determines the quality of the match, saving the match (gain index and pulse sequence) only if it provides a smaller value for the criterion than the value associated with previous matches. If the present pulse sequence provides a better match to the target vector than the value associated with any of the previous sequences, its pulse signs and locations and gain are stored. After all candidate pulse sequences are determined and matched to the target vector, the one resulting in the best match to the target vector is output to the encoder on line 38. Since there are a range of gain levels, the matcher 28 returns control to the gain level selector 24 to select the next gain level. This return of control is indicated by arrow 36.

For the target vector matcher 28, the given error criterion can be implemented, for example, as described in connection with a maximum likelihood criterion, or a minimum mean squared error criterion. For further information pertaining to such processing (and for other related speech processing information), reference may be made to the book entitled, "Probalistic Methods of Signal and System Analysis," 3rd Edition, George R. Cooper and Clare D. McGillen, Oxford Univ. Press, 1999, and the book entitled "Digital Speech Coding for Low Bit Rate Communication Systems," by A. M. Kunooz, John Wiley & Sons, Ltd., West Sussex, England, 1994. As alternatives to such a maximum likelihood criterion, a perceptual quality criterion implemented with empirical testing may be used.

The best match provided by the target vector matcher 28 is then encoded by the optional encoding unit 30 and its parameters are presented at the output of the MPA unit 14. The pulse sequence is typically represented as a series of positive and negative pulses having the current gain level. Optional encoder 30 encodes the output pulse sequence and gain index for storage or transmission.

The SC/GRD 22 of FIG. 1 can be implemented using various approaches. One approach is an embodiment described in U.S. Pat. No. 5,568,588. In this patent, a gain range determination is made to determine an amplitude of the first pulse and then a range of quantized gain levels around the absolute value of the determined amplitude based on a fixed number of steps for moving through the range of quantized gain levels. This relates to the approach of the ITU G.723.1 speech coding recommendation, which is based on the number of steps being fixed at four, for moving through a set range of quantized gain levels.

Another approach is illustrated and described in the above-referenced U.S. patent application Ser. No. 09/086,434. The step size (referred to as MLQ_STEPS) is provided by the MPA unit 14. As applied to the example embodiment of FIG. 1, the gain range determination is a function of the first pulse output of a pulse location determination, an initial quantized gain level, and a set of selected quantized gain levels to be searched as a function of the initial quantized gain level. Both MLQ STEPS and the range of unquantized gain levels searched are a function of the initial quantized gain level, or equivalently, the absolute value of the determined amplitude.

Figure 2:
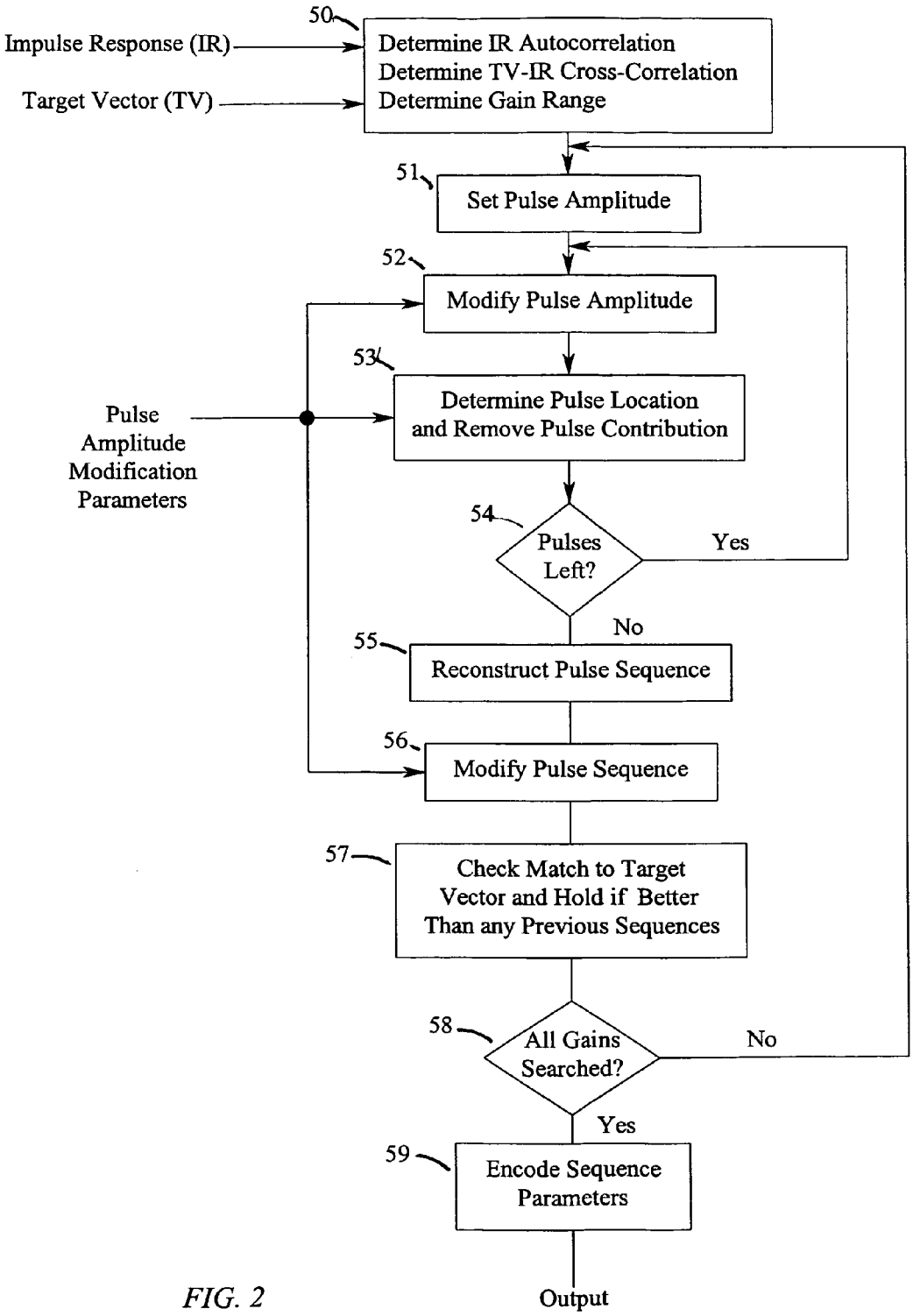
FIG. 2 is a flow chart illustrating speech processing, according an example approach that is consistent with the present invention.

FIG. 2 is a flow chart showing an example manner in which the system of FIG. 1 can be implemented according to the present invention. The example flow begins at block 50, which corresponds to the SC/GRD 22 of FIG. 1. Block 50 determines the IR autocorrelation, the target vector impulse response (TV-IR) cross correlation, and the gain range, as described above and in connection with the ITU G.723.1 speech coding recommendation.

At block 51, the pulse amplitude is selected as described above in connection with the pulse amplitude selector 24 of FIG. 1.

From block 51, flow proceeds to block 52 where the pulse amplitude is modified as a function of pulse amplitude modification parameters. In particular embodiments, these pulse amplitude modification parameters are provided to improve and/or change the perceptual quality of the reconstructed speech by various experimental or methodical approaches. An example of an experimental approach is the result of empirically testing and, therefrom, defining these pulse amplitude modification parameters. An example of a methodical approach involves establishing these pulse amplitude modification parameters as exponentially-based function, as described more fully below. Block 52 modifies the pulse amplitude of each pulse in a given sequence during the location search phase of the MPA unit 14.

From block 52, flow proceeds to block 53 where the pulse location is determined and is optionally modified to apply a selection bias that varies with location in the analysis frame. The pulse location determination operation at block 53 uses pulses of varying amplitude within a given pulse sequence. This selection bias can optionally change on a frame-by-frame basis. Further, at block 53, the pulse contributions, as provided in connection with block 52, are removed. This removal can be readily accomplished by, for example, by subtracting each pulse's contribution to the reconstructed signal from the target vector. For a given sequence, the operations of block 53 are executed once for each pulse.

Block 54 reflects the determination of whether to return to block 52 if there are additional pulses to choose or, if there are not additional pulses to choose, to proceed to block 55. Like the pulse location determination operation at block 53, the pulse sequence reconstruction at block 55 uses pulses of varying amplitude within a given pulse sequence.

The operation at blocks 53 and 54 can be implemented as part of the pulse sequence determiner 25 of FIG. 1.

At block 55, the pulse sequence is reconstructed using the digitally coded information received for each pulse (including the pulse sequence's reference, or "central", pulse amplitude, and the location and sign of each pulse) to execute the coder's (encoder and/or decoder) predetermined reconstruction implementation of the sequence around the central pulse amplitude. With the exception of the introduced pulse amplitude variability issues, such reconstruction is conventional and may be implemented, for example, as characterized in the above-mentioned ITU recommendation. The skilled artisan will appreciate that: in various implementations, the term "central pulse amplitude" can refer to the average amplitude value, the median amplitude value, or any centrally-located value within the range of the pulse amplitudes in a given sequence; that the degree of variability introduced in the pulse amplitude can be limited by whether the coder's (encoder or decoder) reconstruction implementation is manufacturer-compatible with the communicatively-coupled coder's (decoder or encoder) reconstruction implementation; and that the coder's (encoder or decoder) reconstruction implementation can be negotiated as selected one of a set of prestored or loadable reconstruction implementations, with the selection occurring at the beginning of or during a communication.

At block 56, the reconstructed pulse sequence is modified based on the pulse amplitude modification parameters and/or on the pulse position within the frame. For example, the reconstructed pulse sequence can be modified by applying a pulse-amplitude gain scaling function to the subframe whereby the applied gain scaling is a function of position within the subframe. The operations depicted at block 55 are typically duplicated in the decoder and the results or output of the operations depicted at block 55 are passed to a synthesis filter for purposes of reconstructing a version of the original speech. The operations depicted at block 56 are included in the decoder as well and typically, but not necessarily, these operations match the operations of the corresponding pulse sequence modifier of the MPA unit 14. If a pulse-train analysis is utilized, unit 53 becomes a pulse train location determiner and unit 55 becomes a pulse train reconstruction unit. In addition, the long-term contribution is often utilized in determining the spacing of pulses within a given pulse train.

The operation at blocks 55, 56 and 57 can be implemented as part of the target vector matcher 28 of FIG. 1. Block 59 depicts the encoding operation that corresponds to the encoder 30 of FIG. 1.

In one embodiment of the present invention, the pulse amplitude modifier unit 52 reduces the first pulse's amplitude of every sequence by 12.5 percent and then increases each successive pulse's amplitude by 6.25 percent. For a sequence of six pulses, this results in a pulse amplitude variation of more than 35 percent. Varying the pulse amplitude during the pulse location search causes the encoder to choose pulse sequence parameters that are different from those the equal amplitude method would choose, and the result is perceptually enhanced speech.

In another embodiment of the present invention, the pulse sequence modifier unit 56 scales each pulse's amplitude as a function of the pulse's position within the frame. This scaling function is a predetermined function of pulse position known both to the encoder's MPA unit and to the corresponding pulse sequence modifier in the decoder. In one implementation of a typical application, this scaling function is an exponentially based function with a negative second derivative, with a total variation across the frame of approximately 10 to 40 percent. In another implementation, this scaling function is an exponentially based function with a negative second derivative, with a total variation across the frame of approximately 20 to 30 percent. In another implementation, this scaling function is a linear function with a total variation across the frame of approximately 10 to 30 percent.

In another embodiment of the present invention, the pulse sequence modifier unit 56 adds a value to each nonzero pulse amplitude as a function of the pulse's position within the frame. This additive function is a predetermined function of pulse position known both to the encoder's MPA unit and to the corresponding pulse sequence modifier in the decoder. For a typical application, this scaling function is based on the excitation signal from previous frames and/or on the long-term characteristics of the input speech signal.

In another embodiment of the present invention, the pulse location determiner unit 53 is modified to account for the pulse modification function used in unit 56. The pulse modification function utilized by unit 56, a function of at least the position in the frame, is thus also used to modify the pulse location criterion used by unit 53 in selecting successive pulse locations. Typically this pulse location criterion is the cross-correlation between the impulse response input and the target vector input, as determined initially by block 50 and as modified with each successive pulse position by unit 53. The cross-correlation is thus scaled by the same amount that unit 56 would scale a pulse in the same position. If it is desired to apply a bias toward a selection of certain pulse positions, unit 53 can be modified using a different function or modified using the inverse of the pulse amplitude modification function used by unit 56.

In other possible embodiments of the present invention, the amplitude modification functions utilized by units 52 and/or 56 are functions of any one or more of the following: (1) the excitation signal from previous frames; (2) the open loop pitch parameters of the present or any previous frame as determined by a long-term pitch analyzer; and (3) the short-term characteristics of the present or any previous frame as determined by the short-term analyzer.

In addition, the pulse location determiner block 53 can be replaced with a pulse train location determiner and the pulse sequence reconstruction block 55 can be replaced with a pulse-train sequence reconstruction unit in order to implement a varying amplitude multi-pulse-train analysis system. The system can then optionally perform both a pulse-sequence analysis and a pulse-train analysis and choose the result that produces a closer match to the target vector.

It will be appreciated that the blocks shown in the above figures can be implemented on a digital signal processing chip, or in software operating on a general purpose processor. Alternatively, these illustrated embodiments can be implemented using a multi-processor circuit implementation such as described in connection with pending U.S. patent application Ser. No. 09/005,053 filed on Jan. 9, 1998 (now U.S. Pat. No. 6,124,882), incorporated herein by reference, and such an implementation contemplates the speech data being processed in a circuit that is discrete with respect to a circuit for processing video data as well as a single circuit that processes both the speech and the video data.

Accordingly, the present invention provides a number of advantages. These advantages include, among others, embodiments realizing desirable voice/sound modifications and certain noise reduction qualities. The various embodiments described above are provided by way of illustration only and are not intended to limit the invention. Those skilled in the art will readily recognize various modifications and changes that may be made to the present invention, without strictly following the example embodiments and applications illustrated and described herein. For example, it will be appreciated that blocks 52 and 56 permit many more embodiments than are described here, and that generally the list of preferred embodiments described above is in no way meant to be exhaustive of the set of possible embodiments of this invention. Further, variations on the example operations can be made for a given design specification. Thus, the present invention is not limited by the example embodiments; rather, the scope of the present invention is set forth in the following claims.

What is claimed is:

1. In a speech processing system including a signal processor arrangement that analyzes an input speech signal and, in response, generates the short-term characteristics of the input speech signal and a target vector, a method of analyzing the input speech signal comprising:

generating from the target vector and the short term characteristics, a plurality of sequences of variable-amplitude pulses, each of the sequences having a different average amplitude value; and outputting a signal corresponding to a sequence of equal-amplitude pulses which, according to an error criterion, represents the target vector.

2. A system according to claim 1, wherein the target vector is matched using a perceptual weighting criterion.

3. A speech processing system including a signal processor arrangement that analyzes an input speech signal and, in response, generates the short-term characteristics of the input speech signal and a target vector, comprising:

means for generating from the target vector and the short term characteristics, a plurality of sequences of variable-amplitude pulses, each of the sequences having a different average amplitude value; and means for outputting a signal corresponding to a sequence of equal-amplitude pulses which, according to an error criterion, represents the target vector.

4. A system according to claim 3, wherein the target vector is matched using a perceptual weighting criterion.

5. A speech processing system including a signal processor arrangement that analyzes an input speech signal and, in response, generates the short-term characteristics of the input speech signal and a target vector, comprising:

an analyzer adapted to receive the target vector and the short term characteristics and to generate a plurality of sequences of variable-amplitude pulses, each of said sequences having a different average amplitude value;

the analyzer being further adapted to output a signal corresponding to a sequence of equal-amplitude pulses which, according to an error criterion, represents the target vector.

6. A system according to claim 5, wherein the target vector is matched using a perceptual weighting criterion.

7. A speech processing system including a signal processor arrangement that analyzes an input speech signal and, in response, generates the short-term characteristics of the input speech signal and a target vector, comprising:

a multi-pulse analyzer adapted to receive the target vector and the short term characteristics and to generate a plurality of sequences of variable-amplitude, variable-sign and variably-spaced pulses, each of said sequences having a different average amplitude value, each of said pulses within each sequence having variable amplitudes and variable signs;

the multi-pulse analyzer being further adapted to output a signal corresponding to a sequence of equal-amplitude, variable-sign, variably-spaced pulses which, according to a maximum likelihood criterion, most closely represents the target vector.

8. A system according to claim 7, wherein the target vector is matched using a perceptual weighting criterion.

9. A system according to claim 7, wherein the pulse amplitude variations are based on at least one of: the exponential function; a linear function; the short-term characteristics of the input speech signal; the long-term characteristics of the input speech signal; and an excitation signal from previous frames.

10. A speech processing system comprising:

a short-term analyzer that analyzes an input speech signal, and in response to said input speech signal, generates the short-term characteristics of the input speech signal;

a target vector generator for generating data including a target vector from at least said input speech signal, and optionally, said short-term characteristics; and a multi-pulse analyzer adapted to receive the target vector and the short term characteristics and to generate a plurality of sequences of variable amplitude, variable sign, variably-spaced pulses, each of said sequences having a different average amplitude value, each of said pulses within each sequence having variable amplitudes and variable signs, said multi-pulse analyzer for outputting a signal corresponding to the sequence of equal amplitude, variable sign, variably spaced pulses which, according to a maximum likelihood criterion, most closely represents said target vector.

11. A system according to claim 10, wherein the target vector is matched using a perceptual weighting criterion; and wherein the pulse amplitude variations are based on at least one of: the exponential function; a linear function; the short-term characteristics of the input speech signal; the long-term characteristics of the input speech signal; and an excitation signal from previous frames.

12. A speech processing system comprising:

a short-term analyzer that analyzes an input speech signal, and in response to said input speech signal, generates the short-term characteristics of the input speech signal;

a target vector generator for generating a target vector from at least said input speech signal, and optionally, said short-term characteristics; and a multi-pulse analyzer connected to an output line of said target vector generator and an output line of said short term analyzer, wherein said multi-pulse analyzer generates a plurality of sequences of variable amplitude, variable sign, variably spaced pulses, each of said sequences having a different average amplitude value, each of said pulses within each sequence having variable amplitudes and variable signs, said multi-pulse analyzer for outputting a signal corresponding to the sequence of variable amplitude, variable sign, variably spaced pulses which, according to the maximum likelihood criterion, most closely represents said target vector.

13. A system according to claim 12, wherein the target vector is matched using a perceptual weighting criterion.

14. A system according to claim 13, wherein the pulse amplitude variations are based on at least one of: the exponential function; a linear function; the short-term characteristics of the input speech signal; the long-term characteristics of the input speech signal; and an excitation signal from previous frames.

15. A speech processing system comprising:

a short-term analyzer that analyzes an input speech signal, and in response to said input speech signal, generates the short-term characteristics of the input speech signal;

a target vector generator for generating a target vector from at least said input speech signal, and optionally, said short-term characteristics; and a multi-pulse analyzer connected to an output line of said target vector generator and an output line of said short term analyzer, wherein said multi-pulse analyzer generates a plurality of sequences of variable amplitude, variable sign, variably spaced pulses, each of said sequences having a different average amplitude value, each of said pulses within each sequence having variable amplitudes and variable signs, said multi-pulse analyzer for outputting a signal corresponding to the sequence of variable amplitude, variable sign, variably spaced pulses which, according to the maximum likelihood criterion, most closely represents said target vector, and one or more pulse sequence modifiers, each having as input at least a sequence of equal amplitude, variable sign, variably spaced pulses, wherein each said pulse sequence modifier modifies its input sequence and produces as output a sequence of variable amplitude, variable sign, variably spaced pulses.

16. A system according to claim 15 wherein the pulse sequence modification function is based on at least one of: the exponential function; a linear function; the short-term characteristics of the input speech signal; the long-term characteristics of the input speech signal; and an excitation signal from previous frames.

17. A speech processing system comprising:

a short-term analyzer that analyzes an input speech signal, and in response to said input speech signal, generates the short-term characteristics of the input speech signal;

a long-term analyzer that analyzes an input speech signal, and in response to said input speech signal, generates the long-term characteristics of the input speech signal;

a target vector generator for generating a target vector from at least said input speech signal, and optionally, said short-term characteristics, and optionally, said long-term characteristics; and a pulse-train sequence analyzer connected to at least an output line of said target vector generator and an output line of said short term analyzer, wherein said pulse-train sequence analyzer generates a plurality of sequences of variable amplitude, variable sign, variably spaced pulse trains, each of said sequences having a different average amplitude value, each of said pulse trains within each sequence having variable amplitudes and variable signs, said pulse-train sequence analyzer for outputting a signal corresponding to the sequence of equal amplitude, variable sign, variably spaced pulse trains which, according to the maximum likelihood criterion, most closely represents said target vector.

18. A system according to claim 17, wherein the pulse amplitude variations are based on at least one of: the exponential function; a linear function; the short-term characteristics of the input speech signal; the long-term characteristics of the input speech signal; and an excitation signal from previous frames.

19. A system according to claim 18, wherein the target vector is matched using a perceptual weighting criterion.

20. A speech processing system comprising:

a short-term analyzer that analyzes an input speech signal, and in response to said input speech signal, generates the short-term characteristics of the input speech signal;

a long-term analyzer that analyzes an input speech signal, and in response to said input speech signal, generates the long-term characteristics of the input speech signal;

a target vector generator for generating a target vector from at least said input speech signal, and optionally, said short-term characteristics, and optionally, said long-term characteristics; and a pulse-train sequence analyzer connected to at least an output line of said target vector generator and an output line of said short term analyzer, wherein said pulse-train sequence analyzer generates a plurality of sequences of variable amplitude, variable sign, variably spaced pulse trains, each of said sequences having a different average amplitude value, each of said pulse trains within each sequence having variable amplitudes and variable signs, said pulse-train sequence analyzer for outputting a signal corresponding to the sequence of variable amplitude, variable sign, variably spaced pulse trains which, according to the maximum likelihood criterion, most closely represents said target vector.

21. A system according to claim 20, wherein the target vector is matched using a perceptual weighting criterion.

22. A system according to claim 20, wherein the pulse amplitude variations are based on at least one of: the exponential function; a linear function; the short-term characteristics of the input speech signal; the long-term characteristics of the input speech signal; and an excitation signal from previous frames.

23. A system according to claim 21, wherein the pulse amplitude variations are based on at least one of: the exponential function; a linear function; the short-term characteristics of the input speech signal; the long-term characteristics of the input speech signal; and an excitation signal from previous frames.

24. A system according to claim 21 wherein the pulse amplitude variations are based on at least one of: the exponential function; a linear function; and characteristics of the input speech signal.

25. A speech processing system comprising:

a short-term analyzer that analyzes an input speech signal, and in response to said input speech signal, generates the short-term characteristics of the input speech signal;

a long-term analyzer that analyzes an input speech signal, and in response to said input speech signal, generates the long-term characteristics of the input speech signal;

a target vector generator for generating a target vector from at least said input speech signal, and optionally, said short-term characteristics, and optionally, said long-term characteristics; and a pulse-train sequence analyzer connected to at least an output line of said target vector generator and an output line of said short term analyzer, wherein said pulse-train sequence analyzer generates a plurality of sequences of variable amplitude, variable sign, variably spaced pulse trains, each of said sequences having a different average amplitude value, each of said pulse trains within each sequence having variable amplitudes and variable signs, said pulse-train sequence analyzer for outputting a signal corresponding to the sequence of variable amplitude, variable sign, variably spaced pulse trains which, according to the maximum likelihood criterion, most closely represents said target vector, and one or more pulse-train sequence modifiers, each having as input at least a sequence of equal amplitude, variable sign, variably spaced pulse trains, wherein each said pulse sequence modifier modifies its input sequence and produces as output a sequence of variable amplitude, variable sign, variably spaced pulse trains.

26. A system according to claim 25, wherein the target vector is matched using a perceptual weighting criterion.

27. A system according to claim 25, wherein the pulse amplitude variations are based on at least one of: the exponential function; a linear function; the short-term characteristics of the input speech signal; the long-term characteristics of the input speech signal; and an excitation signal from previous frames.

28. A system according to claim 25, wherein the pulse-train sequence modification function is based on the exponential function.

29. A system according to claim 25, wherein the pulse-train sequence modification function is based on a linear function.

30. A system according to claim 25, wherein the pulse-train sequence modification function is based on the short-term characteristics of the input speech signal.

31. A system according to claim 25, wherein the pulse-train sequence modification is based on the long-term characteristics of the input speech signal.

32. A system according to claim 25, wherein the pulse-train sequence modification function is based on an excitation signal from previous frames.

* * * * *